US007424125B2

(12) United States Patent
Amae et al.

(10) Patent No.: US 7,424,125 B2
(45) Date of Patent: Sep. 9, 2008

(54) ERGONOMIC BEHIND-THE-HEAD PERSONAL AUDIO SET AND METHOD OF MANUFACTURING SAME

(75) Inventors: Dominic Amae, Vancouver, WA (US); Robert Jacobson, Camas, WA (US)

(73) Assignee: Logitech Europe SA, Romanel-sur-Morges (CH)

( * ) Notice: Subject to any disclaimer, the term of this patent is extended or adjusted under 35 U.S.C. 154(b) by 0 days.

(21) Appl. No.: 11/260,671

(22) Filed: Oct. 26, 2005

(65) Prior Publication Data

US 2006/0239490 A1 Oct. 26, 2006

Related U.S. Application Data

(60) Provisional application No. 60/622,880, filed on Oct. 26, 2004.

(51) Int. Cl.
*H04R 25/00* (2006.01)

(52) U.S. Cl. ..... 381/374; 381/378; 381/370

(58) Field of Classification Search ..... 381/370–371, 381/373, 374, 378; 379/430, 438.02, 446, 379/449; D14/205, 223
See application file for complete search history.

(56) References Cited

U.S. PATENT DOCUMENTS 6,373,942 B1 * 4/2002 Braund ..... 379/430
6,385,325 B1 * 5/2002 Nageno et al. ..... 381/370

OTHER PUBLICATIONS

International Search Report; PCT app. No. PCT/US05/38724; Oct. 26, 2005; 2 pages.
Written Opinion of the International Searching Authority; PCT app. No. PCT/US05/38724; Oct. 26, 2005; 6 pages.
Notification of Transmittal of International Search Report and Written Opinion; PCT app. No. PCT/US05/38724; Oct. 26, 2005; 1 page.

* cited by examiner

*Primary Examiner*—Suhan Ni
(74) *Attorney, Agent, or Firm*—Townsend and Townsend and Crew LLP

(57) ABSTRACT

A behind-the-head personal audio set for a personal audio device is disclosed. The personal audio set has a headband portion sized to grasp the crown area of the wearer's head while aligning at least one ear cup adjacent to the wearer's ear. The headband portion defines a longitudinal, substantially horizontal, axis that substantially intersects the center of the ear cup. In disclosed preferred embodiments, the ear cup defines an ear engaging plane and the preferred geometry of this ear engaging plane with respect the headband portion's longitudinal axis and an axis of symmetry are also disclosed. Preferably, the headband portion and ear cup portion are integrally molded and ear loops are over-molded, or dual molded, thereto.

21 Claims, 4 Drawing Sheets

ERGONOMIC BEHIND-THE-HEAD PERSONAL AUDIO SET AND METHOD OF MANUFACTURING SAME

CROSS-REFERENCE TO RELATED APPLICATIONS

This application claims priority to U.S. provisional patent application Ser. No. 60/622,880 filed on Oct. 26, 2004.

FIELD OF THE INVENTION

The present invention relates to an ergonomic behind-the-head personal audio set, such as a headset, headphones, or the like, and a related preferred method for manufacturing it.

BACKGROUND OF THE INVENTION

Personal audio-sets, commonly known as headphones, earphones, headsets, and the like, are gaining in popularity. The typical personal audio-set includes a frame containing an earphone that is usually positioned over or in a wearer's ear. In cases where the audio-set is a headset, a microphone is also typically positioned near the wearer's mouth.

One method for detachably securing a personal audio-set to a wearer includes securing the personal audio-set to a headband that encircles the rear portion of the wearer's head. These types of mounting structures are commonly known as "behind-the-head" mounts.

Despite the benefits of behind-the-head mounted headsets, they have several drawbacks. For example, they can be difficult to align correctly when putting them on. In addition, because the drivers in these known mounts tend to hang below the headbands, the size of the drivers that may be used with known behind-the-head mounts is limited. In addition, some known headband designs tend to become loose during use, and they also tend to apply too much pressure to a wearer's ears or head, thereby adversely impacting the wearer's comfort.

SUMMARY OF THE INVENTION

Accordingly, despite the available improvements offered by behind-the-head personal audio sets and the like, there remains a need for a behind-the-head personal audio set that is more comfortable and that remains properly positioned during use. In addition to other benefits that will become apparent in the following disclosure, the present invention fulfills these needs.

The present invention is a behind-the-head personal audio set for a personal audio device that has a headband portion sized to grasp-the wearer's crown area with at least one ear cup portion aligned with one of the wearer's ears. The headband portion has a longitudinal, substantially horizontal, axis that substantially intersects the center of the ear cup portion. In a preferred embodiment, the ear cup portion defines an ear engaging plane and the angle between said ear engaging plane and the longitudinal axis is between 90-110 degrees inclusive. In an alternative preferred embodiment, the headband portion is symmetrical when viewed from the top, defining an axis of symmetry, and the angle between the axis of symmetry and the ear engaging plane is between 30 to 40 degrees, inclusive.

Preferably, two ear cup portions are provided, one for each ear of the wearer, and each ear cup portion preferably includes an ear loop operably secured thereto. The headband portion and ear cups are preferably integrally molded with a first material, and the ear loop is over-molded, or dual molded, thereto.

DETAILED DESCRIPTION OF PREFERRED EMBODIMENTS

A behind-the-head personal audio set 30 having a headband portion 36 extending between a left ear-engaging portion 37*b* and a right ear-engaging portion 37*a* is shown in FIGS. 1-11. A first preferred embodiment is shown in FIGS. 1-7, and a second preferred embodiment is shown in FIGS. 8-11.

Referring to FIGS. 1-7, each ear-engaging portion 37*b*, 37*a* defines a substantially symmetrical ear cup 41 for operably receiving earphone components therein and properly aligning them with a wearer's left and right ears, respectively. The personal audio set 30 includes electronics such as one or more drivers and a structure for connecting the headset to an audio device, such as a personal audio device such as an MP3 player, cellular phone, or the like. More preferably, the personal audio set 30 is wirelessly connected to the audio device. In cases where the personal audio set 30 is a headset, the personal audio set also includes a microphone in communication with the electronics.

Figure 1:
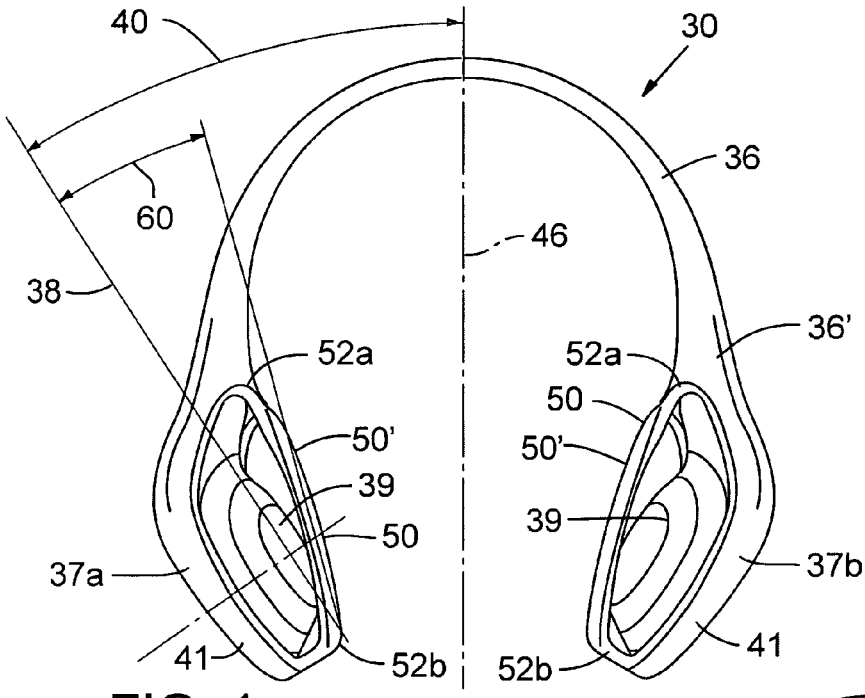
FIG. 1 is a top view of a behind-the-head personal audio set in accordance with an embodiment of the present invention showing a possible first angle for an earphone plane.
Figure 4:
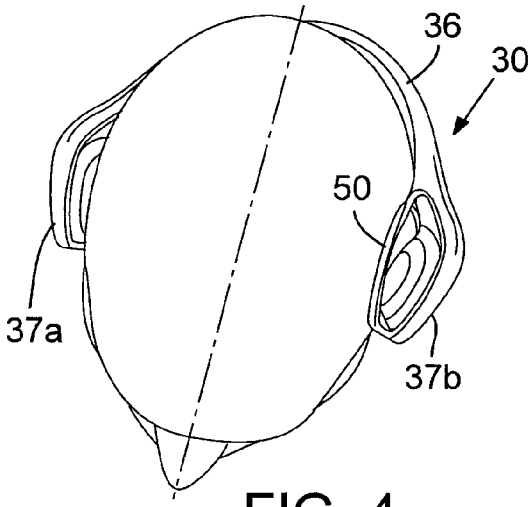
FIG. 4 is a top view of the behind-the-head personal audio set of FIG. 1 showing a possible orientation on a wearer's ear.
Figure 5:
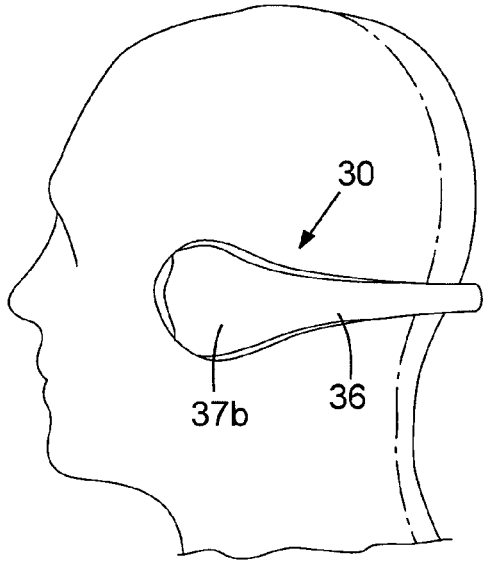
FIG. 5 is a left side view of the behind-the head personal audio set on a wearer of FIG. 4. The right side view is a mirror image thereof.
Figure 6:
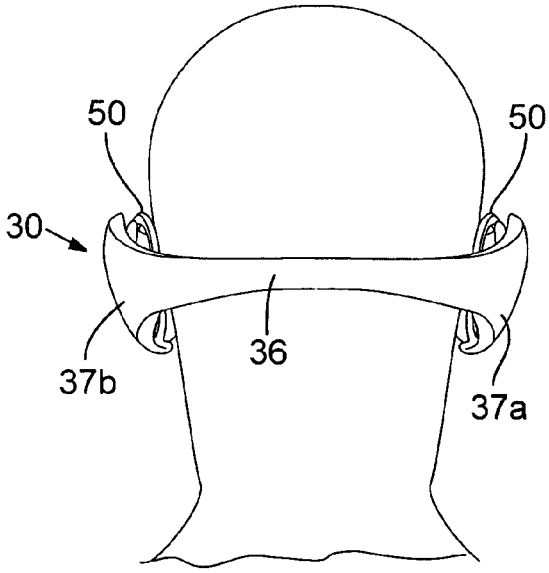
FIG. 6 is a rear view of the behind-the-head personal audio set on a wearer of FIG. 4.
Figure 7:
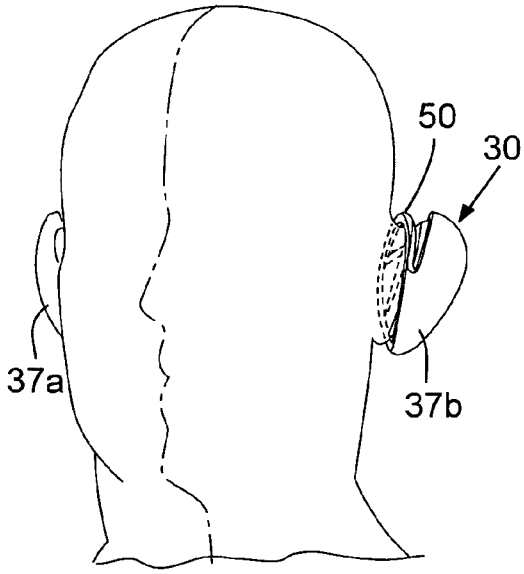
FIG. 7 is a front view of the behind-the-head personal audio set of a wearer of FIG. 4.

As best shown in FIGS. 1, 4 and 5, the headband portion 36 is preferably curved so as to extend around the rear and side crown areas of a wearer's head. More preferably, the curve of the headband has a relaxed shape that is slightly smaller than this engaging crown area so as to slightly grasp this area of the wearer's head when worn.

Figure 3:
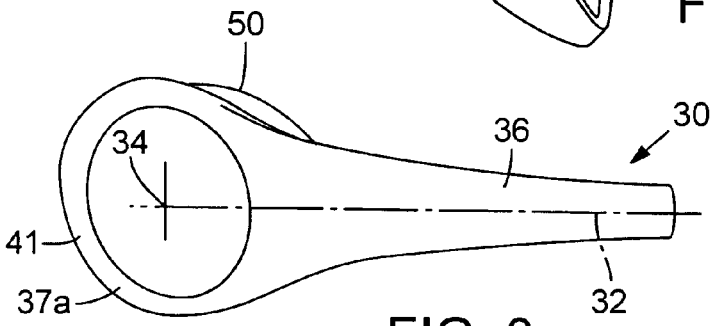
FIG. 3 is a left side view of the behind-the-head personal audio set of FIG. 1.

Referring to FIG. 3, the headband portion 36 is preferably substantially symmetrical about its longitudinal centerline 32 so as to define a substantially horizontal planar structure. Of course, due to angle 42 this is not perfectly symmetrical. More preferably, the longitudinal centerline 32 intersects the center 34 of each ear cup 41.

Figure 2:
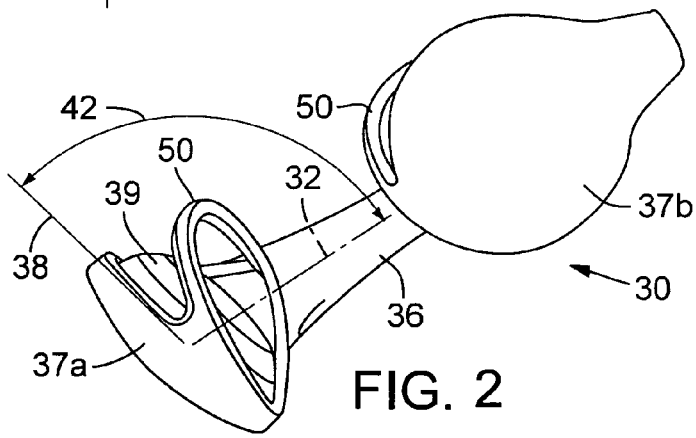
FIG. 2 is a front view taken normal to the earphone plane of FIG. 1 showing a possible second earphone angle.

Referring to FIGS. 1 and 2, the headband portion 36 is defined so as to align the ear-engaging plane 38 of each headphone 39 along two predefined angles 40, 42 as shown. As shown in FIG. 1, the first angle 40 is the angle between the symmetrical centerline 46 of the personal audio set 30 when viewed from the top to the ear-engaging plane 38 of the headphone 39. Preferably, this angle 40 is about 33 degrees plus or minus 20 degrees, when the headband portion 36 is in its neutral state, not installed on a wearer. More preferably, it is plus or minus 10 degrees. Even more preferably, it is plus or minus 5 degrees when the personal audio set 30 is in its neutral state, not installed on a wearer.

As shown in FIG. 2, the second angle 42 is the angle between the longitudinal centerline 32 of the headband portion 36 and the ear-engaging plane 38 of the headphone 39. Preferably, this second angle 42 is about 103 degrees plus or minus 10 degrees. More preferably, it is plus or minus 5 degrees. Even more preferably, it is plus or minus two degrees when the personal audio set 30 is in its neutral state, not installed on a wearer.

Preferably, ear loops 50 operably engage the wearer's ears thereby assisting in holding the personal audio set 30 in place during use. More preferably, the ear loops 50 are elongate bands 50' having spaced apart ends 52*a*, 52*b* that are joined to the ear-engaging portions 37*b*, 37*a* of the personal audio set 30 as best shown in FIG. 1.

Preferably, each ear loop 50 extends from the ear-engaging plane 38 of the headphones 39 at about an 18 degree angle 60 plus or minus about 10 degrees as shown in FIG. 1. More preferably, this angle 60 is plus or minus about 5 degrees. Even more preferably, this angle 60 is plus or minus about 2 degrees. Preferably a monolithic structure such as molded elastomer or the like is used to form the elongate bands 50' and the ear-engaging portions 37*b*, 37*a*.

Referring to FIGS. 8-11, a second preferred personal audio device 30' is disclosed. In order to prevent undue repetition, like elements between the first and second preferred embodiment are like numbered.

Figure 9:
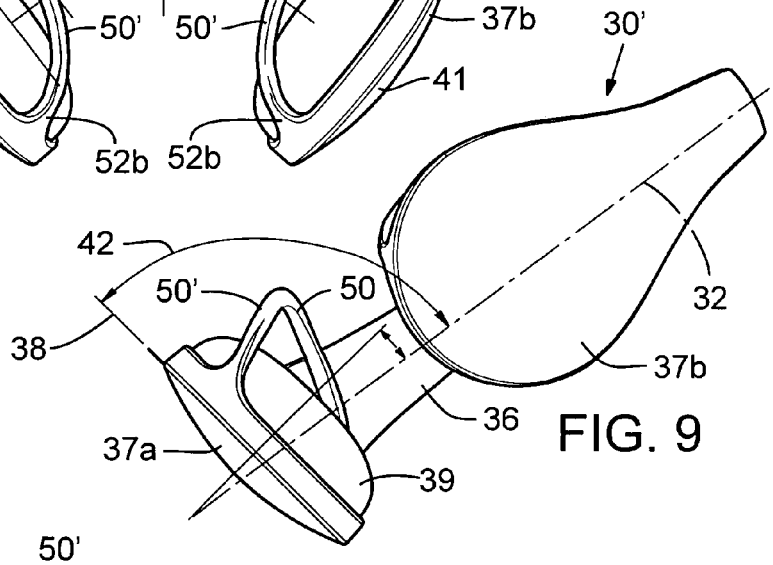
FIG. 9 is a front view taken normal to the earphone plane of FIG. 8 showing a possible second earphone angle.
Figure 10:
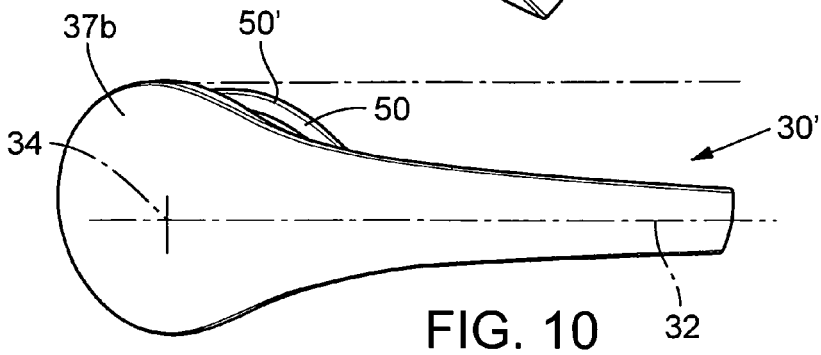
FIG. 10 is a left side view of the behind-the-head personal audio set of FIG. 8.
Figure 11:
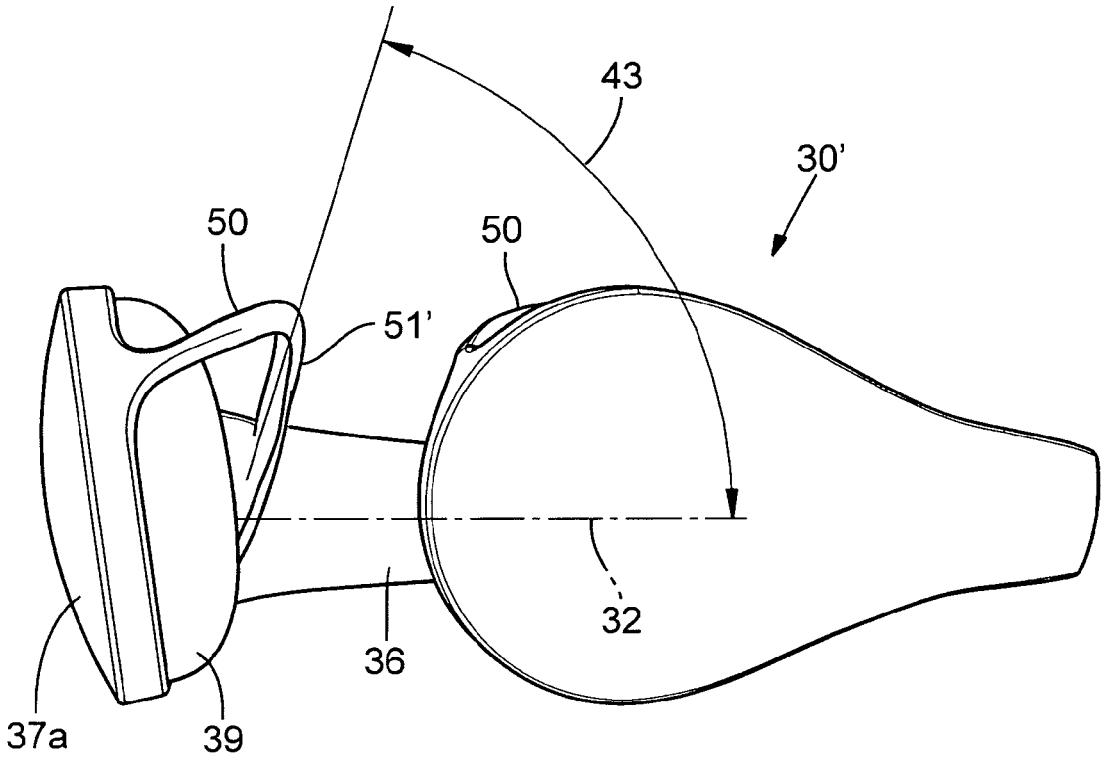
FIG. 11 is a view of the behind-the-head personal audio set of FIG. 8 taken from an angle normal to the first angle 40 defined in FIG. 8.

Referring to FIGS. 9 and 10, the headband portion 36 of this embodiment is defined so as to align the ear-engaging plane 38 of each headphone 39 along two predefined angles 40, 42 as shown. As shown in FIG. 9, the first angle 40 is the angle between the symmetrical centerline 46 of the personal audio set 30 when viewed from the top to the ear-engaging plane 38 of the headphone 39. Preferably, this angle 40 is about 37 degrees plus or minus 20 degrees, when the headband portion 36 is in its neutral state, not installed on a wearer. More preferably, it is plus or minus 10 degrees. Even more preferably, it is plus or minus 5 degrees when the personal audio set 30 is in its neutral state, not installed on a wearer.

As shown in FIG. 10, the second angle 42 is the angle between the longitudinal centerline 32 of the headband portion 36 and the ear-engaging plane 38 of the headphone 39. Preferably, this second angle 42 is about 98 degrees plus or minus 10 degrees. More preferably, it is plus or minus 5 degrees. Even more preferably, it is plus or minus two degrees when the personal audio set 30 is in its neutral state, not installed on a wearer.

Preferably, ear loops 50 operably engage the wearer's ears thereby assisting in holding the personal audio set 30 in place during use. These ear loops 50 also help guide proper installation of the personal audio set 30 in the head of a wearer. More preferably, the ear loops 50 are elongate bands 50' having spaced apart ends 52*a*, 52*b* that are joined to the ear-engaging portions 37*b*, 37*a*. of the personal audio set 30 as best shown in FIG. 10.

Figure 8:
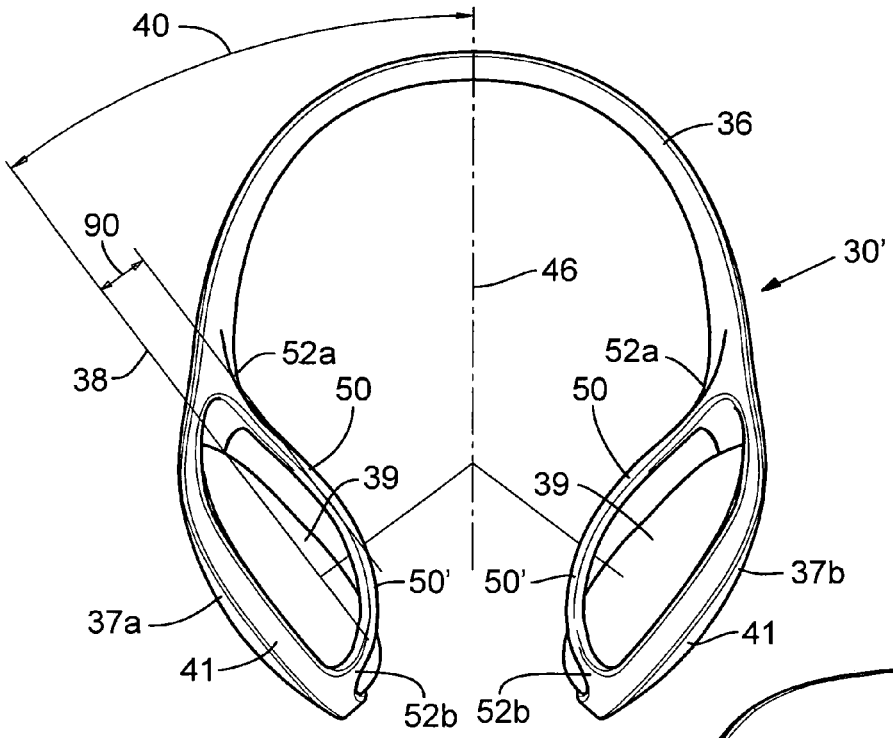
FIG. 8 is a top view of a behind-the-head personal audio set in accordance with an alternative embodiment of the present invention showing a possible first angle for an earphone plane.

Preferably, each ear loop 50 extends from the ear-engaging plane 38 with a portion of the ear loop being aligned substantially parallel to the ear-engaging plane 38 as best shown when comparing lines 90 in FIG. 8. More preferably, the apparent ear loop angle 43 (FIG. 11) defined by the angle between the longitudinal centerline 32 and the plane of the substantially parallel portion of the ear loop is about 71.8 degrees, plus or minus 20 degrees. This angle 43 is not critical, and can be modified as needed for a particular application.

Preferably a monolithic structure such as molded plastic or the like is used to form the elongate bands 50' and ear pad engaging portions 54.

The headphone is preferably dual molded. Preferably, the headband portion 36 is first molded to the desired angles with a relatively hard, but flexible plastic or the like, thereby forming a pre-molded structure 36'. Wires needed for the headset can be positioned on or within the pre-molded structure, 36' and the pre-molded structure 36' is then loaded into an overmold tool.

A softer, more comfortable, thermoplastic, TPU, or other elastomer is then molded onto the pre-molded structure 36' thereby dual molding the personal audio set 30. Preferably, the ear loops 50 are formed during this stage. Such dual molding improves the strength and durability of the personal audio set 30, provides a more aesthetically pleasing structure, improves durability, provides increased protection for internally routed wires and the like, reduces the reveal between parts, and improves the water resistance of the personal audio-set.

Having described and illustrated the principles of our invention with reference to a preferred embodiment thereof, it will be apparent that the invention can be modified in arrangement and detail without departing from such principles. In view of the many possible embodiments to which the principles may be put, it should be recognized that the detailed embodiment is illustrative only and should not be taken as limiting the scope of our invention. Accordingly, we claim as our invention all such modifications as may come within the scope and spirit of the following claims and equivalents thereto.

We claim:

1. A behind-the-head mounted personal audio set for mounting to the crown area of a wearer's head, said personal audio set comprising:

a substantially elongate headband portion defining a longitudinal centerline occupying a substantially horizontal plane, said headband portion curved to encircle the crown of the wearer's head and substantially symmetrical about said longitudinal centerline; and, an ear cup portion operably secured to the headband portion so as to be positioned substantially near one of the wearer's ears, said ear cup portion having a center that substantially intersects said longitudinal centerline of the headband portion.

2. The behind-the-head mounted personal audio set of claim 1, wherein:

said headband portion is substantially symmetrical when viewed from the top, thereby defining an axis of symmetry;

said ear cup portion defines an ear engaging plane; and, a first angle, defined as the angle between said axis of symmetry and said ear engaging plane, is 33 degrees plus or minus 20 degrees, when the headband portion is not being worn by the wearer.

3. The behind-the-head mounted personal audio set of claim 2, wherein said first angle is 33 degrees plus or minus 10 degrees.

4. The behind-the-head mounted personal audio set of claim 3, wherein said first angle is 33 degrees plus or minus 5 degrees.

5. The behind-the-head mounted personal audio set of claim 1, wherein:

said ear cup portion defines an ear engaging plane; and, a second angle, defined as the angle between said longitudinal centerline and said ear engaging plane is 103 degrees plus or minus 10 degrees, when the headband portion is not being worn by the wearer.

6. The behind-the-head mounted personal audio set of claim 5, wherein said second angle is 103 degrees plus or minus 5 degrees.

7. The behind-the-head mounted personal audio set of claim 1, wherein:

said headband portion is substantially symmetrical when viewed from the top, thereby defining an axis of symmetry;

said ear cup portion defines an ear engaging plane; and, a first angle, defined as the angle between said axis of symmetry and said ear engaging plane, is 37 degrees plus or minus 20 degrees, when the headband portion is not being worn by the wearer.

8. The behind-the-head mounted personal audio set of claim 7, wherein said first angle is 37 degrees plus or minus 10 degrees.

9. The behind-the-head mounted personal audio set of claim 7, wherein said first angle is 37 degrees plus or minus 5 degrees.

10. The behind-the-head mounted personal audio set of claim 1, wherein:

said ear cup portion defines an ear engaging plane; and, a second angle, defined as the angle between said longitudinal centerline and said ear engaging plane is 98 degrees plus or minus 10 degrees, when the headband portion is not being worn by the wearer.

11. The behind-the-head mounted personal audio set of claim 10, wherein said second angle is 98 degrees plus or minus 5 degrees.

12. The behind-the-head mounted personal audio set of claim 1, further including a second ear cup operably secured to said headband portion, said second ear cup having a center substantially aligned with said longitudinal axis.

13. The behind-the-head mounted personal audio set of claim 1, further including an elongate ear loop having a first end and a second end, and operably secured to the ear cup at said first and second ends.

14. The behind-the-head mounted personal audio set of claim 13, wherein said first end is spaced apart from said second end when said ear loop is secured to said ear cup portion.

15. The behind-the-head mounted personal audio set of claim 1, wherein said ear cup portion defines an ear engaging plane and further including an ear loop aligned substantially parallel to said ear engaging plane.

16. The behind-the-head mounted personal audio set of claim 1, wherein said ear cup portion defines and ear engaging plane and further including an ear loop operably secured to said ear cup portion defining an ear loop plane, and the angle between said ear engaging plane and said ear loop plane is 18 degrees plus or minus 10 degrees.

17. The behind-the-head mounted personal audio set of claim 1, further including an ear loop operably secured to said ear cup portion, said headband portion and ear cup portion integrally molded using a first material, and said ear loop over molded to said ear cup portion using a second material.

18. The behind-the-head mounted personal audio set of claim 17, wherein said first material is more rigid than said second material.

19. A behind-the-head mounted personal audio set for mounting to the crown area of a wearer's head, said personal audio set comprising:

a substantially elongate headband portion defining a longitudinal centerline, occupying a substantially horizontal plane said headband portion curved to encircle the crown of the wearer's head, substantially symmetrical about said longitudinal centerline, and having an axis of symmetry when viewed from above; and, an ear cup portion operably secured to the headband portion so as to be positioned substantially near one of the wearer's ears, said ear cup portion defining an ear engaging plane and having a center that substantially intersects said longitudinal centerline of the headband portion;

a first angle, defined as the angle between said axis of symmetry and said ear engaging plane when the headband portion is not being worn by the wearer, is between 30-40 degrees, inclusive; and, a second angle, defined as the angle between said longitudinal axis and said ear engaging plane when the headband portion is not being worn by the wearer, is between 90 and 101 degrees, inclusive.

20. The behind-the-head mounted personal audio set of claim 19, wherein said first angle is between 33-37 degrees, inclusive, and said second angle is between 98-103 degrees, inclusive.

21. The behind-the-head mounted personal audio set of claim 19, further including an ear loop extending from said ear cup portion, the angle between said ear loop and said longitudinal center line being 71.8 degrees plus or minus 20 degrees.

* * * * *